US007737349B1

(12) United States Patent
Spurgeon et al.

(10) Patent No.: US 7,737,349 B1
(45) Date of Patent: Jun. 15, 2010

(54) DECORATING GUITARS

(75) Inventors: Stephen L. Spurgeon, Longmont, CO (US); Tyler Nylund, Lehi, UT (US)

(73) Assignee: Art Guitar, LLC, Longmont, CO (US)

( * ) Notice: Subject to any disclaimer, the term of this patent is extended or adjusted under 35 U.S.C. 154(b) by 0 days.

(21) Appl. No.: 11/891,586

(22) Filed: Aug. 9, 2007

Related U.S. Application Data

(60) Provisional application No. 60/837,725, filed on Aug. 14, 2006.

(51) Int. Cl.
*G10D 1/08* (2006.01)
*B05D 3/00* (2006.01)
*B05D 1/32* (2006.01)

(52) U.S. Cl. ..... 84/291; 84/267; 84/290; 427/466; 427/469; 427/553; 427/555; 427/558; 347/102

(58) Field of Classification Search ..... 84/291
See application file for complete search history.

(56) References Cited

U.S. PATENT DOCUMENTS 4,794,838 A * 1/1989 Corrigau, III ..... 84/600
5,305,674 A * 4/1994 Fishman et al. ..... 84/291
5,651,308 A 7/1997 Rohwetter et al.
5,889,084 A 3/1999 Roth
5,937,554 A 8/1999 Haugk et al.
6,092,890 A 7/2000 Wen et al.
6,312,123 B1 11/2001 Codos et al.
6,326,419 B1 12/2001 Smith
6,354,700 B1 3/2002 Roth
6,360,656 B2 * 3/2002 Kubo et al. ..... 101/35
6,743,109 B2 6/2004 Kammerer, Jr. et al.
6,903,841 B2 6/2005 Spurgeon et al.
7,012,712 B2 3/2006 Spurgeon et al.
7,168,803 B2 1/2007 Baxter et al.
2002/0008751 A1 1/2002 Spurgeon et al.
2002/0039928 A1 4/2002 Spurgeon et al.
2002/0097280 A1 7/2002 Loper et al.
2002/0103034 A1 8/2002 Kammerer, Jr. et al.

(Continued)

FOREIGN PATENT DOCUMENTS

WO WO2004/078478 9/2004

OTHER PUBLICATIONS

"U.S. Appl. No. 10/859,877 Office Action", (Mar. 19, 2008), 10 pages.

(Continued)

*Primary Examiner*—Jeffrey Donels
*Assistant Examiner*—Christopher Uhlir
(74) *Attorney, Agent, or Firm*—Blakely Sokoloff Taylor & Zafman LLP

(57) ABSTRACT

Apparatus and methods of decorating guitars and other stringed musical instruments are disclosed. In one aspect, a method may include UV printing a first portion of a decoration over a first region of at least part of a guitar using a first ink drop size, and UV printing a second portion of the decoration over a second region of said at least part of the guitar using a second ink drop size. In another aspect, a method may include UV printing a mask layer over a surface of at least a portion of a guitar using a first amount of image constriction and a first amount of feathering, and UV printing a decorative layer over at least a portion of the mask layer using a second amount of image constriction and a second amount of feathering.

16 Claims, 4 Drawing Sheets

U.S. PATENT DOCUMENTS

| | | | | |
|---|---|---|---|---|
| 2002/0135651 | A1 | 9/2002 | Spurgeon et al. | |
| 2003/0087991 | A1* | 5/2003 | Engel et al. | 523/201 |
| 2004/0175218 | A1* | 9/2004 | Katzer | 400/61 |
| 2005/0088693 | A1 | 4/2005 | Schnoebelen et al. | |
| 2005/0103182 | A1 | 5/2005 | Spurgeon | |
| 2005/0152001 | A1 | 7/2005 | Spurgeon et al. | |
| 2006/0158685 | A1 | 7/2006 | Spurgeon et al. | |

OTHER PUBLICATIONS

"Flatbed UV Inkjet Printer: UJF-605C", Mimaki Engineering Co., Ltd., 1 pg.

"Getting the most from Uvijet UV curable jet ink", Sericol Imaging, ISDN: 07193430460, pp. 1-10.

"Guitar Finishes that Strike a Chord with Buyers", Matthew Little, editor; PF Online Feature Article, Retrieved on May 18, 2004 from the Internet at 222.pfonline.com/articles/060302.html., pp. 1-3.

"UV Inkjet Plotter UJF-605C Maintenance Manual", Mimaki Engineering Co., Ltd., Version 1.00, (2004), 131 pgs.

"Yes, white ink is possible!", Mimaki Engineering Co., Ltd., 1 pg.

Notice of Allowance from other U.S. Appl. No. 10/859,877 dated Oct. 21, 2008 (11 pgs.).

"The Sounding Board vol. 9, Jul. 2000", 16 Pgs.

* cited by examiner

DECORATING GUITARS

RELATED APPLICATIONS

The present application claims priority from, and fully incorporates herein, U.S. Provisional Patent Application Ser. No. 60/837,725, entitled "DECORATING GUITARS", and filed on Aug. 14, 2006. The present application also claims priority from, and fully incorporates herein, U.S. patent application Ser. No. 10/859,877, entitled "DECORATING GUITARS", filed on Jun. 2, 2004. U.S. patent application Ser. No. 10/859,877 itself claims priority from U.S. Provisional Patent Application Ser. No. 60/523,194, entitled "DECORATION METHOD AND APPARATUS FOR APPLYING COLOR GRAPHICS AND/OR PHOTOGRAPHY TO GUITARS", filed on Nov. 18, 2003.

COPYRIGHT NOTICE

Contained herein is material that is subject to copyright protection. The copyright owner has no objection to the facsimile reproduction by anyone of the patent document or the patent disclosure, as it appears in the United States Patent and Trademark Office patent file or records, but otherwise reserves all rights to the copyright whatsoever. The following notice applies to the software and data as described below and in the drawings hereto: Copyright © 2007, Stephen L. Spurgeon, All Rights Reserved.

BACKGROUND

1. Field

An embodiment of the invention relates to a method and apparatus to decorate articles. In particular, the embodiment relates to a method and apparatus to decorate guitars and other musical instruments.

2. Background Information

The ability to apply decorations to guitars may offer a number of potential advantages. One advantage is that the decorations may enhance the appeal and level of personalization of the guitar. A musician or collector may select a guitar with a logo, design, or color photograph that suits her individual preferences. The decoration may thereby increase interest in the guitar and stimulate purchases and playing of guitars.

Various techniques, such as inlays, silkscreen, pre-printed sticker or decal application, and airbrush painting, have been used to apply decorations to guitars. However, there are drawbacks with each of these techniques. Airbrushing tends to be limited by the skill of the airbrush artist and tends to be costly and time-consuming. Stickers and decals are generally difficult to apply and tend to cause defects in the manufacturing process when clear coatings are applied on top of the sticker or decal. Further, continuous contact with the playing surface, as well as continued handling, may tend to alter or remove inks or pigments printed direction on the surface of the guitar, for example by silkscreen.

BRIEF DESCRIPTION OF THE SEVERAL VIEWS OF THE DRAWINGS

The invention may best be understood by referring to the following description and accompanying drawings that are used to illustrate embodiments of the invention. In the drawings:

FIG. 2*a* shows a perspective view of form or mold carriers having cavities, according to one embodiment of the invention.

FIG. 2*b* shows a perspective view of frame carriers, according to one embodiment of the invention.

DETAILED DESCRIPTION

An embodiment of the invention relates to a method and apparatus to apply color graphics, designs, photography, or other decorations to guitars or other stringed musical instruments. In the following description, numerous specific details are set forth. However, it is understood that embodiments of the invention may be practiced without these specific details. In other instances, well-known structures and techniques have not been shown in detail in order to avoid obscuring the understanding of this description.

The present inventor has conceived of methods and apparatus to decorate guitars and other musical instruments by applying visually appealing decorations to the guitars and other musical instruments. The methods and apparatus may be employed to provide sharp, bright, and very colorful images, patterns, and other decorations on the front and/or back of the guitar, producing a very attractive product. The inventor hopes and believes that the methods and apparatus may greatly advance the art of decorating guitars and other musical instruments. In addition, the inventor hopes and believes that the decorations may help to simulate and increase interest and participation in purchasing and playing guitars and other musical instruments for a wide range of consumers.

Figure 1:
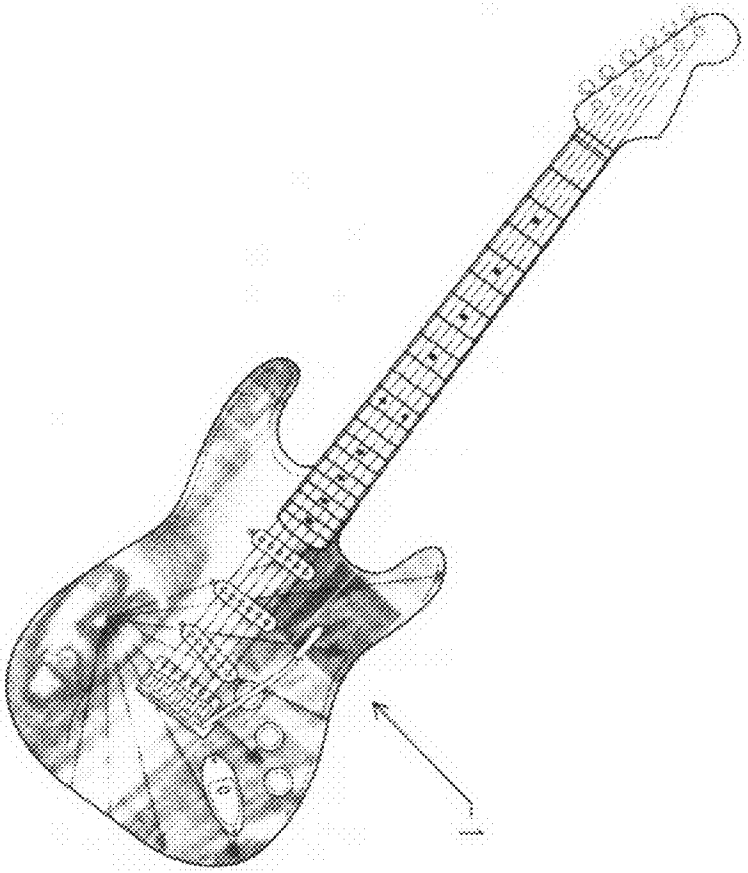
FIG. 1 shows a perspective view of an exemplary guitar decorated in accordance with one embodiment of the invention.

Consider first an exemplary guitar and decoration. FIG. 1 shows a perspective view of an exemplary guitar 1 decorated in accordance with one embodiment of the invention. The guitar generally represents a flat-bodied or contoured top stringed musical instrument having a long fretted neck and usually six strings that may be plucked with a pick or with the fingers, for example. The guitar may include either an electric guitar or an acoustical guitar.

As shown, the guitar is adorned with a decoration applied over a surface thereof. In the illustrated embodiment of the invention, the decoration is applied over a surface of a body of the guitar. It is not required that the decoration be applied to the body of the guitar, or only to the body of the guitar. In another embodiment of the invention, other parts of the guitar, such as the neck, and the back, may also optionally be decorated.

The illustrated decoration includes color graphics, which for convenience are represented as grayscale. The color graphics include a photographic quality representation of a digital image. The digital image includes a face and computer-generated graphics (e.g., arrows). It will be appreciated that the particular decoration illustrated is not required. Other suitable decorations may include photographs, graphical arts, logos, words, or the like.

As will be explained in further detail below, in one embodiment of the invention, the decoration may be formed over the surface of the guitar by printing, spraying, or otherwise applying a radiation-sensitive material over the surface and then polymerizing, cross-linking, solidifying, or otherwise curing the radiation-sensitive material over the surface by exposing the material to appropriate actinic radiation. The decoration may include a solid, cross-linked, polymerized, radiation-cured material having inks dispersed therein. The decoration applied tends not to affect the performance of the guitar during play. In one embodiment of the invention, the decoration may be formed over the surface of the guitar by ultraviolet (UV) printing. In this embodiment of the invention, the decoration may include a cross-linked material cured by actinic UV radiation and having the inks dispersed therein.

UV printing may offer a number of potential advantages. The decorations applied by UV printing tend to be durable, high quality, and the rapid printing speeds tend to lend the process to mass production. The UV printing process also tends to work well on wood and on polymers of the type often used to coat guitars and other stringed musical instruments. In addition, the UV printing process generally employs low or no levels of solvents, which tends to lessen the environmental impact, solvent emissions, and occupational health risks associated with inhalation of vapors.

Due at least in part to the polymerization, the decoration tends to be quite durable. However, an optional coating may often be formed over the decoration in order to help protect the decoration from wear, and enhance the gloss, sheen, and other visual attributes of the guitar. The coating is often referred to in the arts as a topcoat. Commonly employed topcoats include polyurethane coatings and lacquer coatings, such as shellac coatings and nitrocellulose coatings. The addition of the cross-linking, protective coatings may make the decoration more durable, so as to withstand years of use and retain its beauty. Also, the guitar may be cleaned repeatedly without removing or scratching the decoration.

Now, consider an exemplary method of forming the decoration over the surface of the guitar. A method of decorating at least a portion of a guitar, according to one embodiment of the invention, may include providing at least a portion of a guitar, for example a guitar part, having a surface, and applying a decoration over the surface by spraying a radiation-sensitive ink composition or light-activated ink over the surface with one or more ink-jet spray nozzles or printheads and exposing the radiation-sensitive ink composition to radiation or light. The guitar or guitar part may either be for a traditional stringed musical instrument or a more recent guitar shaped music video game controller.

In providing the portion of the guitar, in one embodiment of the invention, a conventionally produced portion of a guitar, such as a guitar body or a guitar neck, may be provided. In one aspect, the portion of the guitar may include a carved or otherwise machined, and optionally sanded, wood guitar body or neck. Exemplary woods conventionally used in the manufacture of guitars include, but are not limited to, alder, poplar, mahogany, and maple. The use of wood in the manufacture of guitars is prevalent, although the invention is not so limited. In another aspect, the portion of the guitar may include a molded or otherwise formed, and optionally sanded, plastic guitar body or neck. Other materials and conventional portions of the guitars may also optionally be employed.

Now, there are numerous options for using from zero to almost any desired number of coatings or layers between the decoration and the wood or other structural surface of the guitar. In one embodiment of the invention, the decoration may be applied directly on a surface of the wood or other material of construction of the guitar. The wood generally offers a porous surface that tends to promote adhesion of the decoration.

Alternatively, in another embodiment of the invention, the decoration may be applied over the surface of the wood or other material of construction of the guitar, with one or more coatings disposed between the decoration and the surface of the wood or other material of construction of the guitar. The one or more coatings may include one or more acrylic coatings, polyurethane coatings, polyester coatings, lacquer coatings (e.g., shellac, nitrocellulose, etc.), lacquer paints, or a combination of such coatings. Embodiments of the invention are not limited to any known coating or combination of coatings. Additionally, in an embodiment of the invention, the decoration may be applied directly to either an acrylic, polyurethane, polyester, or lacquer coating.

For example, in one aspect, a multiple-layer coating may be formed over the wood surface of the guitar, prior to applying the decoration. Initially, a surface of a conventionally carved and sanded wood guitar body may be sealed. A layer or coating of a sealant may be formed over the surface of the wood. Suitable sealants include, but are not limited to, polyurethane coatings, polyester coatings, acrylic coatings, and lacquer coatings (e.g., shellac coatings or nitrocellulose coatings). If desired, multiple coats may be used. Then, after sealing the surface, an optional layer of lacquer or urethane paint, or another type of conventional, commercially available paint, may be formed over the sealed surface. The paint may have any desired color, such as black, blue, red, purple, white, or another desired color. Next, if the optional layer of paint is applied, another layer or coating of polyurethane, polyester, acrylic, or lacquer (e.g., shellac or nitrocellulose) may optionally be formed over the layer or coating of paint. A single coating or multiple coatings may be employed. In forming the above coatings or layers, spay coating may be employed, as well as electrostatic spray coating, dip coating, roll coating, painting, or other coating methods known in the guitar manufacturing arts. Sanding with a fine sand paper, steel wool, or the like, may optionally be performed, such as, for example, if there is a rough texture, to improve adhesion, or to provide a smoother final surface, prior to application of one or more of these coatings. Then, the decoration may be printed over, or directly on, the above-described multiple layer coating.

According to one embodiment of the invention, to help improve adhesion of the decoration, the decoration may be applied directly on a curable material prior to the material being completely cured. Suitable materials include, but are not limited to, tacky polyurethanes, tacky polyesters, tacky acrylics, and tacky lacquers (e.g., tacky shellac or tacky nitrocellulose materials), or otherwise incompletely cured or incompletely hardened materials. Applying the decoration directly on such tacky or incompletely cured materials may also tend to enhance the adhesion of the decoration. Additionally, depending upon the particular material, the radiation and/or heat provided by the process used to apply the decoration may assist with curing the material. Accordingly, the radiation and/or heat may potentially tend to speed up the curing time and help to increase manufacturing throughput. In one aspect, a radiation-sensitive species, such as a photoinitiator or other radiation-sensitive catalyst, and/or a heat-sensitive species, may be included in the tacky or otherwise incompletely cured material.

As another option, according to one embodiment of the invention, one or more coatings may optionally be heated just prior to applying a decoration. The heating may tend to soften the coatings and/or reduce their viscosity. This may tend to improve adhesion of a timely applied decoration that is applied while the coatings are heated and/or softened. In one or more embodiments of the invention, a UV printer may be used to heat the one or more coatings. For example, in one or more embodiments of the invention, the UV or other actinic light of the printer may be passed over or otherwise emitted on the one or more coatings already on the guitar substrate. The light may heat the coatings. This heating process may be performed before application of the decoration inks has begun, such as, for example, as a preceding cycle in which the light source is run over the guitar substrate prior to the cycle in which the decoration is applied. Alternatively, in another embodiment of the invention, a printer may be equipped with two light sources, one to pass over the guitar substrate first to heat it and another to pass over the guitar substrate after the curable inks of the decoration have been applied to the guitar substrate in order to cure the inks. This may help to improve adhesion of the decorations, but is optional and not required. Similarly, an additional cycle of light may optionally be applied after the application and initial cure of the decoration in order to heat or soften the decoration and underlying layer somewhat, which may also help to promote good adhesion of the decoration to the underlying layer.

According to another embodiment of the invention, a hardened curable material or other hard material may optionally be sanded or otherwise roughened. The roughening of the surface may tend to improve adhesion of the decoration and/or improve the look and/or feel of the decorated musical instrument. This may be desirable especially if the underlying coating has a rough or uneven surface, but is optional and not required. In one embodiment of the invention, the surface may be roughened with 280 to 400 grain sand paper, steel wook, or the equivalent, to provide good adhesion.

According to yet another embodiment of the invention, the decoration may be formed directly on a UV print primer coating. A suitable UV print primer coating is the 51209B print primer available from Northwest Coatings, of Oak Creek, Wis. The 51209B print primer includes a mixture of acrylate monomers and oligomers having a boiling point of greater than 200° C. and a vapor pressure of less than 1 mm Hg at 25° C. Other UV print primers may also optionally be employed. A coating of the UV print primer may be formed over the surface of the guitar. In one aspect, the primer may be sprayed over the wood surface of the guitar, or over a polyurethane coated, lacquer coated, or otherwise coated surface of the guitar. Painting, roll-coating, dip coating, and other methods of application may also optionally be employed. Printing the decoration directly on the UV print primer coating may tend to enhance the printing and adhesion of the decoration.

Figure 2A:
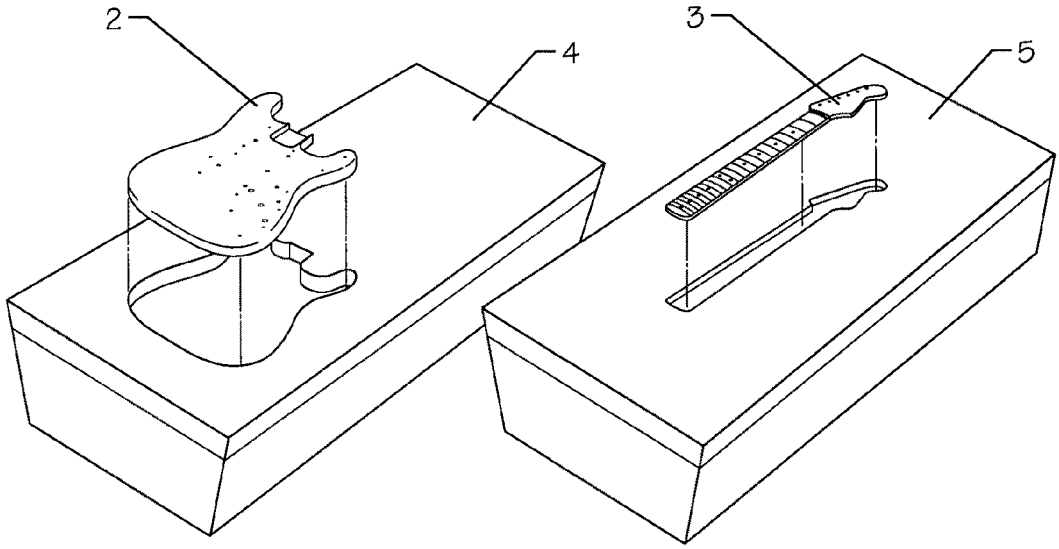
FIGS. 2*a*-2*b* show perspective views of carriers, according to different embodiments of the invention.
Figure 2B:
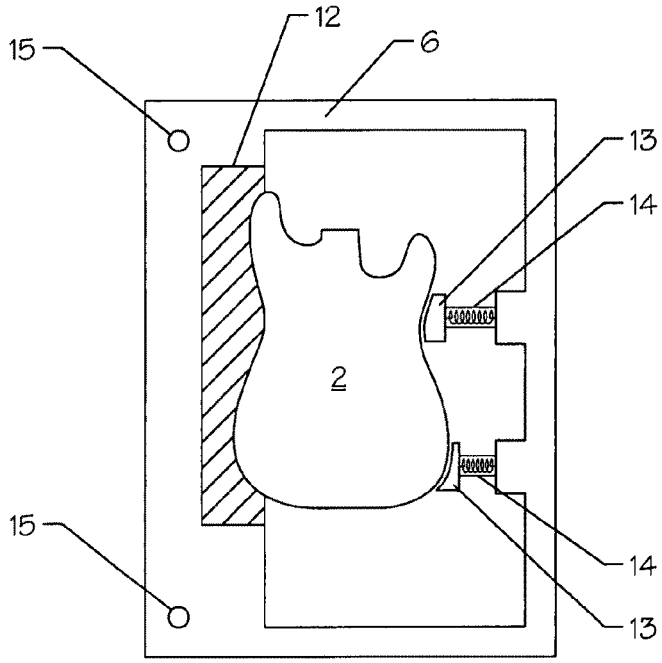
Figure 3:
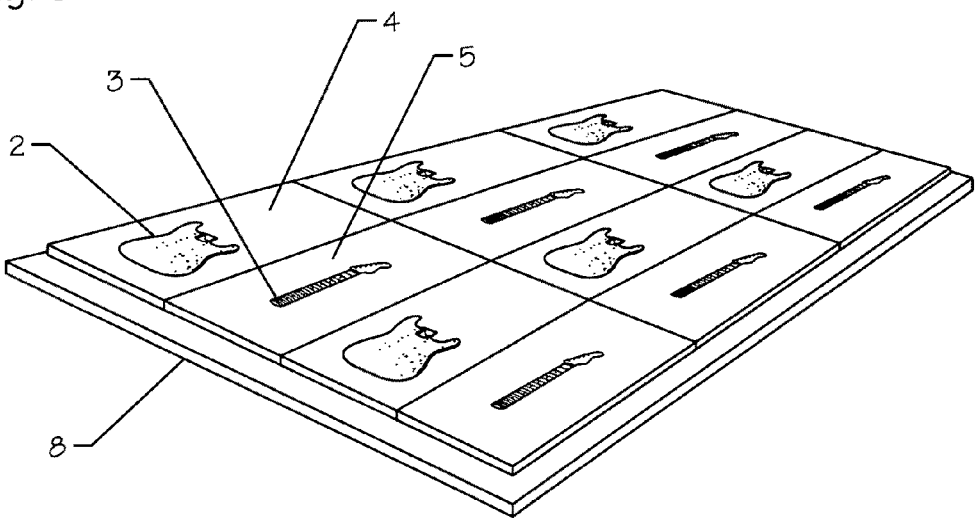
FIG. 3 shows a perspective view of a print-bed, a plurality of standardized carriers on the bed, and body and neck parts of guitars in the carriers, according to one embodiment of the invention.
Figure 4:
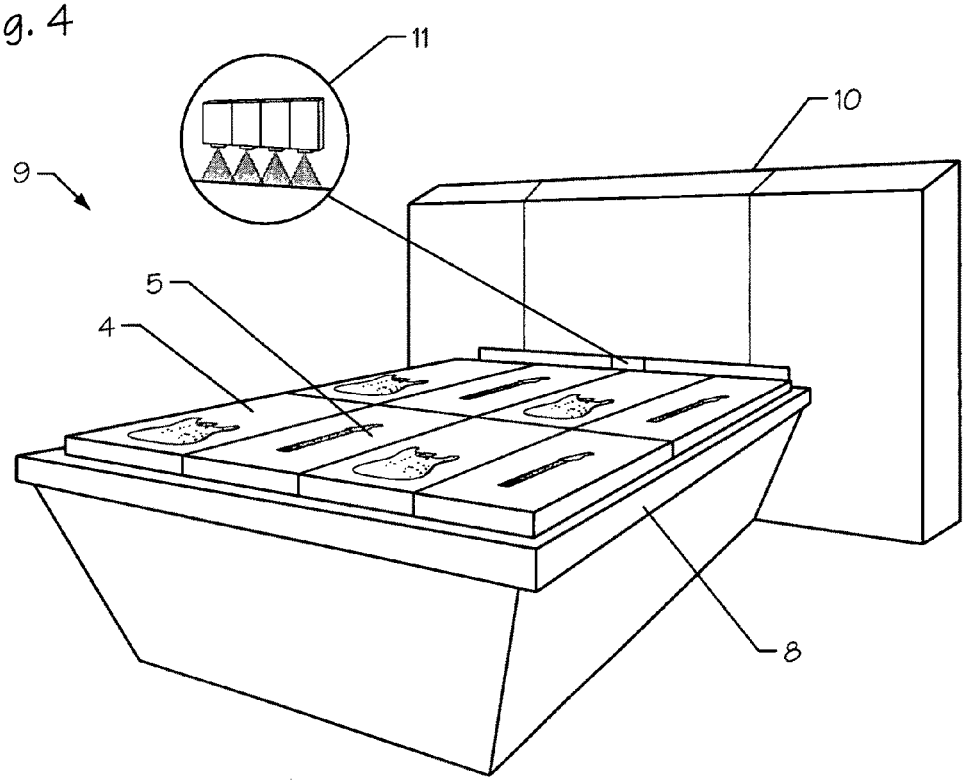
FIG. 4 shows a perspective view of a guitar decorating apparatus, according to one embodiment of the invention.

FIGS. 2-4 show an approach, according to one embodiment of the invention, for holding guitar parts in carriers, supporting the carriers on a print-bed, and printing on the guitar parts with an ink-jet printing apparatus. This is only one contemplated approach and this approach is not required. In the following, first the carriers will be described, then the print-bed and the placement of the carriers on the print-bed will be described, then the ink-jet portion and printing process will be described.

FIGS. 2*a*-2*b* show perspective views of carriers, according to different embodiments of the invention. The carriers may be used to receive and hold guitar parts, such as bodies and necks. The guitar parts may either be for a traditional stringed musical instrument or a more recent guitar shaped music video game controller. The guitar parts may be placed or positioned in the carriers prior to forming the decoration over their surfaces. The guitar parts often have irregular surfaces and rounded edges. The carriers may tend to facilitate handling the guitar parts and aligning and orienting them with respect to the apparatus in order that the decoration is properly aligned and oriented on the guitar.

FIG. 2*a* shows a perspective view of forms or molds 4, 5 that include cavities to accommodate guitar elements or parts 2, 3 having varying shapes and sizes, according to one embodiment of the invention. A first form 4 (on the left) includes a cavity having a size and shape corresponding to a body 2 of a guitar to receive the body. A second form 5 (on the right) includes a cavity having a size and shape corresponding to a neck 3 of a guitar to receive the neck. The parts may have a thickness of a guitar, which is often between about ⅛" and 6" in thickness, and may have a solid or open-cavity wood body, depending on the particular type of guitar. The parts may include of various materials, such as plastic, metal, and especially wood. As shown, the cavities may be defined such that planes of the body or neck of the guitar may be generally aligned or coplanar with the top surface of the forms. In one aspect, the cavities may extend through an entire thickness of the forms so that the forms may be flipped over and printing may be performed on the backside of the guitar without removing the part from the form. Many alternate embodiments are also contemplated. For example, in a first alternate embodiment of the invention, a single form may include cavities for both a body and a neck of a single guitar. As another example, in a second alternate embodiment of the invention, a single form may include cavities for two or more bodies or two or more necks. The forms may be made of a variety of materials including, but not limited to, aluminum, wood, and plastic.

FIG. 2*b* shows a perspective view of a frame 6 that includes an optionally removable block having an edge thereof shaped like an edge of a guitar part, and springs to hold or bias a guitar part against the edge, according to one embodiment of the invention. The frame includes an optionally removable and replaceable block 12. A right hand (as shown) edge or surface of the block may have a shape mated with, corresponding to, or at least based on, a potentially curved shape of an edge or surface of a guitar body 2 to help register the guitar body with the frame to ensure proper orientation of the guitar body. In one aspect, the length of the shaped edge of the block may be sufficient ensure that the guitar body is properly positioned in the frame to provide good orientation. Different shaped blocks corresponding to different shapes of guitars, such as Stratocaster, V-shape, etc. may be used with the same frame.

The frame also includes guitar retention surfaces 13 and springs 14 to engage or bias the guitar retention surfaces with an opposing edge or surface of the guitar body. As shown, in one or more embodiments of the invention, the surfaces may optionally be shaped or contoured to conform or mate with a portion of the guitar, although this is not required. The guitar retention surfaces may comprise a cushioning or rubbery material. The springs may help to hold the portion of the guitar in the frame. The springs may bias or engage the guitar part retention surfaces into contact with the guitar part when the guitar part is placed in proper position in the frame. The springs may each be encased in an encasement to ensure that they stay in the plane of the frame. The springs and encasements may be attached to a side of the frame opposite the removable block.

The frame also includes a registration system to help register the frame with a bed. In the illustrated embodiment, the registration system includes a pin hole 15 in each of two corners of one side of the frame. In this embodiment, pins of the print-bed may be inserted into the pin holes in order to align the frame relative to the print-bed. This may tend to promote proper orientation of the decoration on the surface of the guitar.

In one aspect, both the front and back of the guitar part may be exposed when placed in the frame. If desired, the frame may be flipped over and printing may be performed on the backside of the parts of the guitar without removing the part from the frame. The frames may be made of a variety of materials including, but not limited to, aluminum, wood, and plastic.

In one aspect, the carriers may be standard-sized carriers, for example standard-sized forms or frames. The standard-sized carriers may have one or more standard exterior dimensions. In one aspect, the dimension may be sufficient to accommodate the smallest to the largest article or part of a guitar. For example, the forms may have a width sufficient to accommodate a width of a guitar body and a length sufficient to accommodate a length of a guitar neck. Alternatively, the length may be sufficient to accommodate a length of an assembled guitar. In one aspect, a first standard-sized carrier for a body may have substantially the same size and shape as a second standard-sized carrier for a neck. This may tend to allow a plurality of the standard-sized carriers to be arranged in a substantially reticulated or grid-like arrangement on a print-bed or conveyor (or other electronically controlled moving bed), for example.

FIG. 3 shows a perspective view of a print-bed 8, a plurality of standardized carriers 4, 5 on the bed, and body 2 and neck 3 parts of guitars in the carriers, according to one, embodiment of the invention. In the particular embodiment illustrated, the carriers include forms having cavities as shown in FIG. 2*a*, although frames may also be employed.

As shown, the carriers may be arranged in a substantially reticulated or grid-like arrangement on a surface of the print bed. In the illustrated embodiment, the bodies and the necks of a guitar may be arranged adjacent to one another. Also, in the illustrated embodiment, the bodies are arranged in a line relative to the print bed, and the necks are likewise arranged in a line. In the illustrated embodiment, two lines of bodies and two lines of necks are shown. It will be appreciated that this particular arrangement of carriers is not required. The standardized carriers may be interchangeable in position on the bed. For example, in another embodiment of the invention, there may be only two lines of adjacent carriers, and both lines of carriers may hold guitar body parts.

Often, it may be appropriate to secure or attach the carriers in proper position on the bed so that they do not move around. This may be accomplished in a variety of ways. In one aspect, since the carriers have standardized shapes, a carrier or a predefined plurality of carriers may fit within predefined confines of the bed. For example, the bed may have a frame, edge, ledge, or divider to provide a confine or cavity for one or more carriers. The print-bed may include a cavity that is sized to closely receive therein one or more standard-sized forms or carriers. In one aspect, the bed may have a plurality of such confines to define the substantially reticulated or grid-like arrangement of the carriers. In another aspect, the bed and/or the carriers may have fasteners to provide the attachment and potentially the substantially reticulated or grid-like arrangement. For example, the bed and/or the carriers may have clamps, clips, pins, bolts, screws, magnets, or other fasteners. In one particular example, the bed may have a plurality of regularly-spaced, rigid pins and the carriers may each have at least one corresponding pin hole to mate with a rigid pin by way of pin registration in which the hole of the carrier is inserted over the pin in order to hold the carrier in precise position. In yet another aspect, the carriers may simply be arranged manually in the appropriate arrangement and monitored.

FIG. 4 shows a perspective view of a guitar decorating apparatus 9, according to one embodiment of the invention. The apparatus 9 includes a jet-printing device 10; a plurality of ink-jet spray nozzles or other printheads 11 of the jet printing device; a plurality of standard-sized forms 4, 5 (other carriers may also optionally be employed), each of the standard sized forms having a standard exterior dimension to accommodate a largest guitar part; a cavity of each of the plurality of standard-sized forms, each of the cavities having a shape of a guitar part; a bed 8 to receive the plurality of standard-sized forms; an integrated digital graphics computer interface (not shown), the integrated digital graphics computer interface to cause the plurality of ink-jet spray nozzles 11 to spray a decoration onto a guitar part positioned in a cavity of a form; and a light (not shown) to apply light to the guitar part. In the illustrated apparatus, the guitar parts are shown as part of the apparatus, although this is not required, and in another embodiment of the invention, an apparatus may omit the guitar parts. The carriers and the apparatus are capable of holding and decorating guitar bodies and the like of various shapes and thickness. The carriers may accommodate the guitar parts and shapes using, in one aspect, a predesigned set of molds which are formed in standard sizes to attach to the print bed and which are also customized within their interior to accommodate the sizes and shapes of the various guitar bodies or parts and the like.

The particular apparatus illustrated in FIG. 4 is not required. A guitar decorating apparatus, according to another embodiment of the invention, may include a carrier to hold a portion of a guitar; a surface to support the carrier; one or more jet-spray nozzles or other printheads to spray radiation-sensitive ink on a surface of the portion of the guitar, when the portion of the guitar is held by the carrier, and when the carrier is supported by the surface; and a radiation source to supply radiation to the radiation-sensitive ink on the surface of the portion of the guitar.

In one embodiment of the invention, the apparatus may include a high-speed jet-printing apparatus such as a UV ink-jet printer. A variety of UV ink-jet printers are commercially available from numerous sources. Suitable UV ink-jet printers include, but are not limited to, the Durst Rho 160, available from Durst Dice America, of Rochester, N.Y., the 3M® Printer 2500 UV, available from 3M Commercial Graphics Division, of St. Paul, Minn., the Inca Eagle 44, available from Sericol Imaging, of Kansas City, Kans., the Leggett and Platt Virtu, available from Leggett & Platt Digital Technologies, of Jacksonville Beach, Fla., the Scitex VeeJet, available from Scitex Vision America Inc., of Marietta, Ga., the PressVu UV™ 180/600 EC and PressVu UV™ 180/360 EC, both available from VUTEk, Inc., of Meredith, N.H., and the Zund Uvjet 215, available from ACCI, of Edina, Minn. Another notable printer is the UJF-605C Flatbed UV Inkjet Printer, available from Mimaki Engineering Co., LTD, of Tokyo, Japan.

Prior to printing, a digital image may be loaded into the apparatus. The apparatus may include an integrated digital graphics computer interface. In one aspect, in addition to accessing the digital image, a shape file corresponding to a shape of a guitar or guitar part to be printed on may be accessed. Different files may be provided for different types of guitars, such as Stratocaster, V-shape, or the like. The integrated digital graphics computer interface may rasterize the digital image for the printer. A printer driver may be used for this purpose. Then, the rasterized representation of the digital image may be used by the integrated digital graphics computer interface, or another suitable controller, to control the printing or other application of the decoration on the surface by the ink-jet spray nozzles.

Figure 5:
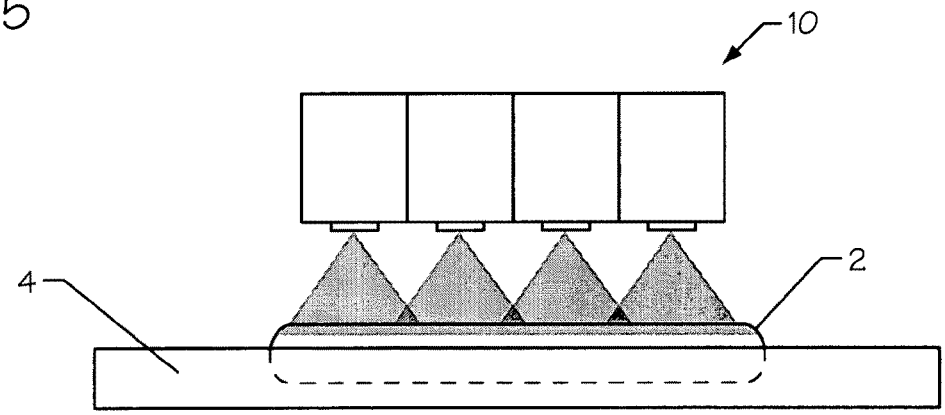
FIG. 5 shows a cross-sectional view of a plurality of ink-jet spray nozzles spraying or otherwise applying a radiation-sensitive ink composition to a surface of a guitar part positioned in a carrier, according to one embodiment of the invention.

FIG. 5 shows a cross-sectional view of a plurality of ink-jet spray nozzles 10 spraying or otherwise applying a radiation-sensitive ink composition over a surface of a guitar part 2 positioned in a carrier, according to one embodiment of the invention. It should be noted that terms such as "over", "top", "bottom", "upper", "lower", "vertical", "horizontal", and the like, are used herein to facilitate the description of the structures as illustrated. It will be evident that the structures may be used in a variety of orientations.

As used herein, the term radiation-sensitive ink composition refers to a composition including ink that is sensitive to radiation and capable of being chemically transformed by the radiation. As used herein, the term ink refers broadly to a colorant and may include inks, dyes, pigment, other colorants (e.g., carbon black), or a combination. In one embodiment of the invention, the radiation-sensitive ink composition may include a UV radiation curable ink composition that is capable of being polymerized, potentially cross-linked, and at least partially solidified by UV radiation. The UV radiation may initiate a polymerization reaction, which may cause polymerization, for example cross-linking, of components in the composition in order to create the solid coating. A heat-activated ink composition may also optionally be employed.

The UV radiation curable ink composition may include one or more monomers, oligomers, inks, and photoinitiators. The monomers often form the bulk of the composition and may be used to adjust the viscosity. In some cases a mixture of monomers, such as monomers capable of giving polyesters and polyacrylates, may be employed. The oligomers often provide properties such as resistance and flexibility to the cured coating. The photoinitiator generally represents a molecule or other species that is sensitive to UV radiation and that is capable of initiating a polymerization reaction when exposed to the UV radiation. The compositions generally contain low levels of solvents or are solvent free. This may offer certain environmental and occupational health advantages, to name a few.

Suitable UV radiation curable ink compositions are commercially available from numerous sources. One suitable composition includes the UV curable ink-jet ink called Uvijet, which is commercially available from Sericol Imaging, of Kansas City, Kans. Other suitable compositions are known in the arts.

In one embodiment of the invention, a material used in an underlying layer may be combined with a UV curable ink-jet ink composition in order to give the UV curable ink-jet composition properties that are more similar to those of the underlying layer and allow the decoration to adhere better. For example, in various aspects, a polyurethane material, polyester material, lacquer material (e.g., nitrocellulose or shellac), conventionally used in guitar manufacture may be included in the UV curable ink-jet composition in an amount of from about 1 to about 50 wt %, or 5 to 20 wt %, for example.

In the illustrated embodiment, four nozzles or printheads are shown. In one aspect, the four nozzles may include separate nozzles for cyan, magenta, yellow, and black colored UV ink compositions. These inks are occasionally known in the arts as CMYK inks. In another embodiment of the invention, the plurality of nozzles may include an additional nozzle for white. As will be explained further below, the white may, among other things, be useful for forming a mask layer over which an image may be applied to help mask underlying colors or features of the surface of the guitar and improve image quality. In yet another alternate embodiment, the plurality may include additional nozzles for light magenta and light cyan. The provision of these additional colored UV ink compositions may help to improve image quality. Accordingly, in one example, the plurality may include seven nozzles, for cyan, magenta, yellow, black, white, light magenta, and light cyan. Other color combinations besides those based on CMYK may also optionally be employed.

As shown in FIG. 5, the composition may be sprayed on the surface of the guitar. In spraying the composition on the surface, the distance from the ink-jet spray nozzles or printheads to the surface of the guitar may affect the visual quality of the decoration. The UJF-605C Flatbed UV Inkjet Printer from Mimaki tends to print well when the distance from the ink-jet spray nozzles to the surface being printed on is in the range of from about 1 to 2 inches. In one embodiment of the invention, the commercially available printer may be modified to lower the print-bed so that the distance is in this range when the guitar part optionally held in a carrier is placed on the print bed. Using such a distance is not required, but may help to promote good print quality. Other distances may be appropriate for other printers.

Shortly after the composition is sprayed on the surface, the radiation-sensitive or UV radiation curable ink composition may be exposed to actinic radiation, for example UV radiation or light, to polymerize, cross-link, solidify, and cure the composition on the surface as a durable decoration. The apparatus may include a bulb, lamp, or other radiation source to provide the UV or other radiation. In the UV ink-jet printing arts, the radiation often includes UV radiation having a wavelength in the range of 200 to 400 nanometers (nm). The radiation may promote the polymerization, cross-linking, solidification, and curing process. In one aspect, the UV radiation may decompose the photoinitiators, which may include a number of well-known radiation-sensitive molecules. Then, the decomposed photoinitiators may initiate the polymerization reactions, which create long, often branched, and potentially cross-linked polymeric chains. The polymerization reactions, including the chain lengthening reactions, branching reactions, and cross-linking reactions, generally tend to cause the material to solidify rapidly. Often, depending upon the particular conditions, the material may solidify within a few seconds. Additionally, the approach tends to be economical and tends to be well suited for either small or larger volume manufacturing.

In one embodiment of the invention, the representation of the image may include a dot matrix representation of the image formed by printing with one or more ink-jet spray nozzles. The dot matrix representation of the image may include a pattern of a plurality of dots substantially arranged in a grid. It will be appreciated that the grid may not be perfect. The term substantially arranged in a grid is meant to include at least the amount of deviation from a perfect grid that is customarily expected for a printer of the type used to form the decoration. Each of the plurality of dots may include a solid, polymerized, cross-linked material that may include one or more colored inks.

As the decoration is being applied, the guitar parts may either move under the ink-jet spray nozzles, or the ink-jet spray nozzles may move over the guitar part, as desired. For example, in one aspect, a guitar part may be positioned face-up in a cavity of a form having a shape of the guitar part when the form is in the open position. Then, a shuttle bed, a conveyor belt, or other moving bed having the form thereon may pass under a jet where light-activated ink may be applied to decorate at least a portion of the outer surface of the guitar. Alternatively, in another aspect, a mechanism may be employed to lock the cavity in place and pass the jet over the stationary guitar surface to apply light-activated ink. The printing speed may depend upon the resolution of the digital image. In one embodiment of the invention, when using the UJF-605C Flatbed UV Inkjet Printer of Mimaki, it may be appropriate to employ print speeds of about 200 $ft^2$/hr for 300 dpi, 55 $ft^2$/hr for 600 dpi, and 20 $ft^2$/hr for 1200 dpi.

In one embodiment of the invention, to help increase the quality or appearance of the decoration, a mask may first be printed in a UV curable ink composition over the surface of the guitar, and then a multi-color image may be printed over the mask in one or more UV curable ink compositions. The mask may be applied over the entire surface of the guitar, or selectively over portions of the guitar that are to receive the multi-color decoration, as desired. In one aspect, the mask may have substantially the same size, shape, and position as the image. In one aspect, the applied mask may optionally be sanded, such as, for example, with a fine sand paper, steel wool, or the like. This may potentially help to improve the look and feel of the decorated guitar and/or help to improve adhesion of the decoration to the mask.

The mask may include a convenient, typically solid, background color. For example, the mask may include a substantially white color. The term substantially white is intended to include off-white colors including yellowish or grayish whites (e.g., ivory). One suitable substantially white UV-curable ink is XaarJet-71W00, available from Xaar plc, of Cambridge, United Kingdom. In one aspect, the mask may include a substantially white UV print primer composition. Other colors, such as gray, blue, or black, for example, may also optionally be employed. Other substantially UV curable ink compositions are available from Mimaki, Durst, and Zund, to name a few.

The mask may tend to mask or conceal the underlying surface of the guitar. If the underlying surface of the guitar tends to be difficult to conceal, for example if it is black or another dark color, then two or more masks or a relatively thicker mask may optionally be employed. That is, the thickness of the mask or the number of masks may be based on the darkness of the color of the underlying surface. Likewise, if the underlying color is sufficiently light, the mask may be omitted.

Since the distance from the ink-jet nozzles to the surface of the guitar may influence the print quality, and since the guitars often have irregular surfaces and rounded edges, various approaches are contemplated to help make the distance more uniform over the various regions of the surface of the guitar. In one embodiment of the invention, in order to accommodate for uneven topography of the guitar, the ink-jet nozzles may be capable of moving up and down (vertically) based on the topography of the guitar or guitar part being printed. In one aspect, a topography map corresponding to the guitar or part may be used to control the vertical position of the nozzles. In another aspect, a distance measurement system may be capable of measuring a distance to a surface of the guitar, and the vertical position of the ink-jet nozzles may be controlled based on the measured distance. In either aspect, the vertical position may be controlled to maintain a substantially uniform distance from the nozzles to the surface of the guitar or part. By substantially uniform is meant more uniform than the topography of the surface of the guitar or part.

Alternatively, rather than having the ink-jet spray nozzles move, the guitar or guitar part may be moved. In one aspect, the carrier may have capability to reposition the guitar or guitar part relative to the ink-jet spray nozzles. For example, the carrier may have capability to tilt, rock, expand, collapse, or the like. The capability may be manual, for example by an operator, or autonomous by the apparatus.

In still another embodiment of the invention, the volume of ink composition for a dot or drop, or the size of the dot or drop of ink, or both, may optionally be controlled based on a distance from the ink-jet printhead to the surface of the guitar. In one aspect, these aspects may be controlled based on a topography map or other data file or guitar data corresponding to the particular topography of the guitar or part. For example, software may calculate, estimate, or otherwise determine the separation distance based on the guitar data. In another aspect, these aspects may be controlled based on a sensed or measured separation distance, such as, for example, between the surface to be printed on and the nozzle where ink is dispensed. For example, a separation distance measurement system may be used to measure or otherwise determine the separation distance in real time during printing. In one aspect, the control may be performed in real time during printing.

Certain UV printers are capable of printing using more than one ink drop size or resolution. By way of example, the UJF-605C Flatbed UV Inkjet Printer, available from Mimaki Engineering Co., LTD, of Tokyo, Japan, is capable of printing at 300 dots per inch (dpi) fixed resolution, 600 dpi fixed resolution, 600 dpi variable resolution, and 1200 dpi resolution. The fixed resolutions use a substantially fixed dot size, whereas the variable resolutions utilize different dot sizes, such as, for example, small, medium, and large dots. These are relative terms.

The higher resolutions tend to provide better quality decorations, at least when printing on smooth, flat surfaces where the print head is sufficiently close to the surface being printed on. Likewise, under such conditions, a variable resolution tends to provide better quality decorations than a fixed resolution.

However, the higher resolutions typically use a smaller average drop size than the lower resolutions. Additionally, the variable resolutions tend to include a proportion of these smaller sized drops. These relatively smaller drops of ink tend to be more susceptible than larger drops to undesirable influences or forces, such as, for example, static electricity and/or air movement or wind due to the movement of the print head or otherwise. The wind or static may tend to move the smaller drops more than the larger drops. As a result, it has been observed that when using such relatively smaller dots in combination with relatively greater separation distances from the surface being printed on, which tends to compound the problems of movement due to static and/or air movement, that non-ideal decoration quality may result. For example, blurry or fuzzy decorations may result. These deleterious affects tend to be directly related to the separation distance between the printer nozzle and the surface being printed on.

Some guitar substrates may have irregular surfaces to be printed on. For example, some guitar manufacturers typically glue the neck of the guitar to the body of the guitar prior to applying polymeric or lacquer coatings to the guitar. Often, the top of the neck may sit higher than the top of the body of the guitar, like a ledge. In one embodiment of the invention, when applying a decoration, a guitar decorating apparatus may use guitar data, such as guitar shape data, to alter a print path or printer height or separation distance based in part on a position of a neck or other topographical information. For example, the guitar decorating apparatus may stop printing prior to a printhead moving over the top or ledge of the neck. In one aspect, this may be done by software within the apparatus based on the current position of the printheads and the guitar data, although this is not required. Such irregular topographical surfaces across the guitar substrate to be printed on may tend to cause, or at least result in, using a greater separation distance between the surface of the guitar substrate to be printed on and the nozzle of the printer.

In one or more embodiments of the invention, a different drop size or resolution may be used for a first region or portion of the printed decoration than for a second region or portion of the printed decoration. In one or more embodiments of the invention, the first and second regions or portions may have different separation distances between the surface being printed and the printer. For example, in one or more embodiments of the invention, a relatively smaller drop size or resolution may be used for a region or portion of the printed decoration having a relatively smaller separation distance, whereas a relatively greater drop size or resolution may be used for a region or portion of the printed decoration having a relatively greater separation distance. In one aspect, a relatively higher fixed resolutions or drop sizes may be used for a relatively smaller separation distance, and a relatively lower fixed resolutions or drop sizes may be used for a relatively greater separation distance. In another aspect, a variable resolution or drop size may be used for a relatively smaller separation distance, and a fixed resolution or drop size may be used for a relatively greater separation distance.

To further illustrate, for the aforementioned Mimaki printer, a relatively higher resolution, such as, for example, a 1200 dpi fixed resolution or 600 dpi variable resolution, may optionally be used for a first region or portion of a decoration when the print head has a relatively smaller separation distance from the portion of the guitar substrate being printed, and a relatively lower resolution, such as, for example, a 600 dpi fixed resolution or 300 dpi resolution, may optionally be used for a second region or portion of a decoration when the print head has a relatively larger separation distance from the portion of the guitar substrate being printed. By way of example, and not limitation, in one particular embodiment of the invention, the higher resolution may be used when the separation distance is less than about 2.5 millimeters, and the lower resolution may be used when the separation distance is greater than about 2.5 millimeters, although the scope of the invention is not limited in this respect. Larger separation distances may tend to favor both lower resolutions and drop sizes and fixed resolutions and drop sizes, over both higher resolutions and drop sizes and variable resolutions and drop sizes. However this is not required.

In one or more embodiments of the invention, prior to printing a decoration, an antistatic composition may optionally be applied to the guitar surface to be printed on. For example, the surface to be printed may be sprayed, wiped, or otherwise contacted with the antistatic composition. Suitable antistatic compositions include, but are not limited to, methanol, ethanol, and other alcohols, glass cleaners, such as, for example, Windex® Glass Cleaner, antistatic sprays, such as, for example, Static Guard®, and other antistatic compositions known in the arts, and combinations thereof. This may help to reduce static, which may tend to move the drops or otherwise adversely affect the printed image. However, this is optional and not required.

A guitar body is three-dimensional and may have a top/main surface that is to be printed on, a peripheral edge around the top surface, and vertical sides adjoining the peripheral edge. It is sometimes desirable to decorate a portion of the top surface right up to a peripheral edge of the guitar. In some cases, much, if not all, of the top surface of the guitar may be decorated, including right up to the peripheral edges.

Drops or other forms of ink that are sprayed over the peripheral edge may tend to accumulate on the vertical sides as unsightly drops, streaks, or other effects. Some printers are capable of printing precisely enough to stop or terminate printing abruptly at the peripheral edge. However, this may tend to produce a harsh/hard transition between the printed decoration and the non-painted surface, which may be unappealing to some users or purchasers. A challenge, when printing right at or in close proximity to a peripheral edge, is how to obtain good image quality on the top surface that will be satisfying to a user or purchaser.

Various approaches are contemplated for dealing with such challenges. In one or more embodiments of the invention, an image may optionally be constricted within an edge of the guitar and then feathered. By way of example, the image may be constricted so that it is within 1/16 to 1/4 of an inch from the edge of at least a portion of the guitar, although the scope of the invention is not so limited. Then the constricted image may be feathered. Feathering or other edge softening may include gradually reducing the opacity and/or the number of ink dots printed as you go away from the image at the edge of the image. The feathering may transition from about 100% coverage on the image side of the feathering region to about 0% coverage on the edge side of the feathering region. In some cases, the feathering may tend to slightly spread out or un-constrict the image in the direction of the edge. Such feathering or edge softening has been used to produce visually appealing decorations while reducing the unsightly overspray effects aforementioned and avoiding the harsh transition. Such feathering or edge softening may be performed by vector drawing or bitmap editing programs, such as, for example, Adobe® Illustrator® and Adobe® Photoshop® products, which are commercially available from Adobe Systems Incorporated, of San Jose, Calif.

As previously mentioned, in one embodiment of the invention, a substantially white or other colored mask layer may be UV printed over the surface before a decorative multi-colored layer. If the mask layer and the decorative layer are constricted and feathered to the same extent, then at least some of the dots of ink of the mask layer may not be covered by the decorative layer. The printer may not be capable of placing ink dots of the decorative layer directly on all of the ink dots of the mask layer in the feathered region. This may cause white or otherwise colored ink dots of the mask layer to show through or stand out, which may tend to adversely affect image quality.

In one or more embodiments of the invention, a substantially white or other colored mask layer may be constricted more and/or feathered more than a decorative multi-colored overlying layer. By way of example, a mask layer may be constricted to be away from the edge of the guitar by a relatively greater amount, and an overlying decorative layer may be constricted to be away from the edge of the guitar by a relatively smaller amount, and both layers may be feathered. The layers may either be feathered to the same extent, or else the mask layer may be feathered more than the decorative layer. In one particular example, the relatively greater amount may be about 1/4 of an inch, and the relatively smaller amount may be about 1/16 of an inch, although the scope of the invention is not so limited. As another example, the mask and decorative layers may be constricted by the same or similar amount and the mask layer may be feathered more (terminate more quickly) than the decorative layer. Such approaches may tend to help reduce the amount of mask layer ink dots not covered by decorative layer ink dots, which may tend to improve image quality.

Another approach, according to one embodiment of the invention, may include applying a protective material to one or more of at least a portion of the peripheral edge and one or more sides of the guitar substrate that is to be printed. Examples of suitable protective materials include, but are not limited to, tape, adhesive papers, viscous compositions, and the like, and combinations thereof. Examples of suitable tapes include, but are not limited to, masking tapes, duct tapes, painters tapes, like tapes, and combinations thereof. Examples of suitable viscous compositions include, but are not limited to, hand and body lotions, petroleum jelly, honey, liquid soaps, acrylic paint, like viscous liquids, and combinations thereof. Dots or other forms of ink that are oversprayed or overprinted the peripheral edge may land on and adhere to the protective material instead of the sides of the guitar. The protective material may then be removed, along with the drops or other forms of ink. For example, the tape may be pealed off or the viscous composition may be wiped off. This may help to reduce the unsightly overspray effects aforementioned and help to avoid the aforementioned harsh transition.

In yet another embodiment of the invention, these aforementioned approaches may optionally be used in combination. For example, feathering and overspraying may optionally be used in combination with the use of a protective material.

Once the decoration has been applied, a topcoat may be applied to the guitar. Suitable topcoats include, but are not limited to, polyurethane, polyester, polyacrylic, and lacquer coatings. An example is POLANE® High Solids Clear Topcoat polyurethane coating, available from The Sherwin-Williams Company, of Cleveland, Ohio. Another example is SHER-W00D® CAB-Acrylic Lacquer from The Sherwin-Williams Company. Yet another example is Lawrence McFadden™ solvent-based nitrocellulose lacquer, available from The Lawrence-McFadden Company, of Philadelphia, Pa. If desired, multiple coats may be used. Then, the topcoat may be buffed to a shine.

In the description above, for the purposes of explanation, numerous specific details have been set forth in order to provide a thorough understanding of the embodiments of the invention. It will be apparent, however, to one skilled in the art, that other embodiments may be practiced without some of these specific details. In other instances, well-known structures, devices, and techniques have been shown in block diagram form or without detail in order not to obscure the understanding of this description.

Many of the methods are described in their most basic form, but operations may be added to or deleted from the methods. For example, in one embodiment of the invention, an old or used conventionally manufactured guitar may be decorated. In one aspect, the decoration may be applied on the top surface of the guitar. In another aspect, one or more coatings or layers of the guitar may be stripped or otherwise removed and then zero or more coatings and a decoration may be applied as described elsewhere herein. It will be apparent to those skilled in the art that many further modifications and adaptations may be made. The particular embodiments are not provided to limit the invention but to illustrate it. While the invention has been described in terms of several embodiments, those skilled in the art will recognize that the invention is not limited to the embodiments described, but may be practiced with modification and alteration within the spirit and scope of the appended claims. The description is thus to be regarded as illustrative instead of limiting. The scope of the invention is not to be determined by the specific examples provided above but only by the claims below.

It should also be appreciated that reference throughout this specification to "one embodiment" or "an embodiment" means that a particular feature may be included in the practice of the invention. Similarly, it should be appreciated that in the foregoing description of exemplary embodiments of the invention, various features are sometimes grouped together in a single embodiment, Figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

In the claims, any element that does not explicitly state "means for" performing a specified function, or "step for" performing a specified function, is not to be interpreted as a "means" or "step" clause as specified in 35 U.S.C. Section 112, Paragraph 6. In particular, the use of "step of" in the claims herein is not intended to invoke the provisions of 35 U.S.C. Section 112, Paragraph 6.

What is claimed is:

1. A method comprising:

ultraviolet (UV) printing a first portion of a decoration over a first region of at least part of a guitar using a first ink drop size capability of a printer;

UV printing a second portion of the decoration over a second region of said at least part of the guitar using a second ink drop size capability of the printer, wherein the first region has a greater separation distance from a printhead used to print on the first region than the second region has from a printhead used to print on the second region, and wherein the first ink drop size is greater than the second ink drop size to reduce one or more of blurring the decoration and making the decoration fuzzy.

2. The method of claim 1, further comprising measuring the separation distance.

3. The method of claim 1, further comprising calculating the separation distance based on guitar shape data.

4. The method of claim 1, wherein the first portion of the decoration is printed with a fixed resolution, and wherein the second portion of the decoration is printed with a variable resolution.

5. The method of claim 1, further comprising changing the ink drop size in real time during printing based on a topography of said at least part of the guitar.

6. The method of claim 1, wherein the first ink drop size is a first average ink drop size, and wherein the second ink drop size is a second average ink drop size.

7. The method of claim 1, wherein a separation distance between the first region and a printhead used to print on the first region is greater than 2.5 millimeters, and wherein a separation distance between the second region and a printhead used to print on the second region is less than 2.5 millimeters.

8. The method of claim 1, further comprising prior to UV printing the first portion applying an antistatic composition to the first region.

9. The method of claim 1, wherein UV printing the first portion comprises UV printing the first portion of the decoration over the first region of at least part of a guitar shaped game controller.

10. The method of claim 1, further comprising:

UV printing a mask layer over a surface of said at least the part of the guitar using a first amount of mage constriction and a first amount of feathering; and UV printing the decoration over at least a portion of the mask layer using a second amount of image constriction and a second amount of feathering.

11. The method of claim 10, wherein the first amount of image constriction is greater than the second amount of image constriction.

12. The method of claim 10, wherein the first amount of feathering is greater than the second amount of feathering.

13. The method of claim 1, wherein UV printing the first portion comprises using a different resolution than a resolution used for UV printing the second portion.

14. The method of claim 1, wherein said at least part of a guitar comprises a body of the guitar.

15. The method of claim 1, wherein the decoration comprises a multi-colored image that is UV printed over an entire top surface of said at least the part of the guitar.

16. A method comprising:

printing a first portion of a decoration over a first region of a body using a first ink drop size of a printer and radiation curing the first portion of the decoration, wherein the body comprises a body of a guitar shaped music video game controller; and printing a second portion of the decoration over a second region of the body using a second ink drop size of the printer and radiation curing the second portion of the decoration, wherein the first region has a greater separation distance from one or more printheads used to print on the first region than the second region has from one or more printheads used to print on the second region, and wherein the first ink drop size is greater than the second ink drop size to help reduce at least one of blurriness and fuzziness of the decoration.

* * * * *

UNITED STATES PATENT AND TRADEMARK OFFICE

CERTIFICATE OF CORRECTION

PATENT NO. : 7,737,349 B1
APPLICATION NO. : 11/891586
DATED : June 15, 2010
INVENTOR(S) : Spurgeon et al.

It is certified that error appears in the above-identified patent and that said Letters Patent is hereby corrected as shown below:

In column 17, at line 3 delete, "mage" and insert --image--.

Signed and Sealed this

Tenth Day of August, 2010

David J. Kappos

David J. Kappos
*Director of the United States Patent and Trademark Office*